US006607403B2

(12) United States Patent
Tschope et al.

(10) Patent No.: US 6,607,403 B2
(45) Date of Patent: Aug. 19, 2003

(54) CABLE CONNECTOR FOR ELECTRICAL CONNECTIONS

(75) Inventors: Jurgen Tschope, Selm (DE); Reiner Frank, Gevelsberg (DE)

(73) Assignee: DBT Automation GmbH (DE)

( * ) Notice: Subject to any disclaimer, the term of this patent is extended or adjusted under 35 U.S.C. 154(b) by 0 days.

(21) Appl. No.: 09/989,849

(22) Filed: Nov. 21, 2001

(65) Prior Publication Data

US 2002/0076982 A1 Jun. 20, 2002

(30) Foreign Application Priority Data

Nov. 23, 2000 (DE) ..... 100 58 265

(51) Int. Cl.[7] ..... H01R 9/03
(52) U.S. Cl. ..... 439/610
(58) Field of Search ..... 439/610, 578, 439/274, 275, 604, 605; 174/88 C

(56) References Cited

U.S. PATENT DOCUMENTS 3,622,939 A * 11/1971 Forney, Jr. ..... 439/322
3,622,952 A * 11/1971 Koren et al. ..... 439/610
4,025,145 A * 5/1977 Shaffer et al. ..... 439/610
4,397,516 A * 8/1983 Koren et al. ..... 439/610
4,887,971 A * 12/1989 Reuss et al. ..... 439/98
5,167,521 A * 12/1992 Wilferd ..... 439/275
6,113,429 A * 9/2000 Weigel et al. ..... 439/610

FOREIGN PATENT DOCUMENTS

DE 92 08 427.3 U1 10/1992
DE 200 04 565 U1 7/2000
DE 200 04 566 U1 7/2000

* cited by examiner

*Primary Examiner*—Tho D. Ta
*Assistant Examiner*—Larisa Tsukerman
(74) *Attorney, Agent, or Firm*—Cook, Alex, McFarron, Manzo, Cummings & Mehler, Ltd.

(57) ABSTRACT

The invention relates to a plug-in cable connector 3 for electrical cable or plug connections 10. The cable connector 3, which forms the termination of the cable 1, has a hollow connector shell 4 of brass, whose boring forms a cable entry opening on its cable side section and an abutment collar 5 on which a plug connector 6 with a collar 6' is supported axially in one direction. The cable entry opening is provided with an internal thread 22, in which a four cornered part 30 of metal, having a through boring 35 for the cable, is screwed in. The screening or armouring of the cable 1 can be accepted between the through boring 25 and the cable covering 1', so that a good earthing of the cable 1 and the cable connector 3 can be achieved. The interior space of the connector shell 4 is sealed by means of a formed part 27, which is formed onto the cable covering 1', the connector shell 4 and the multi-cornered part 30. The cable 1 is also retained axially on the connector shell 4 by the formed part 27.

12 Claims, 1 Drawing Sheet

CABLE CONNECTOR FOR ELECTRICAL CONNECTIONS

The present invention relates to a cable connector for electrical connections, especially for plug-in couplings of electrical cable connections in underground mining, with a connector shell of metal, which has a cable entry opening provided with an internal thread and an abutment collar or engaging portion for a plug connector of plastics material, which is equipped with plug pins and/or sockets, which are joined to the cable conductors of a single or multi-connector cable, preferably provided with screening or armouring. A preferred area of application is the electrical connection of cable connectors, e.g. to electro-hydraulic support controllers. The present invention is not, however, restricted to underground applications.

Cable connectors of the construction previously mentioned with a connector shell of metal, which have a cable entry provided with an internal thread and an abutment seal for a plug connector of plastics material, which is equipped with plug pins and/or sockets which are joined to the cable wires of a single or multiple core electrical cable, are sold by the assignee. The axial retention of the cable in the connector shell is effected by means of a screw connection of plastics material, which is screwed into the cable entry opening with a threaded plug at one end and at its other end has a compression crown arranged in the form of a ring around the cable, which is clamped by means of a cap onto a sealing sleeve surrounding the outer covering of the cable. The cable side seal of the connector part against moisture depends on the clamping force applied to the sealing sleeve, whereby the compression crown and the gap between the individual teeth forms a weak point for the sealing. For application in plug-in connections the cable connectors are plugged into a socket part and secured to this using a captive coupling ring, whereby a sealing element such as an O-ring is arranged between the socket part and the plug-in cable connector as a protection against the ingress of moisture and/or dirt.

The plug-in cable connectors have however been shown not always to be sufficiently watertight in long term application in wet surroundings and in regions in danger from sprayed water, such as especially exist in underground mining operations. The screwed connections with a compression crown are expensive technically in production. Cable connectors provided with screw connections are therefore economically non-competitive owing to their high price. Apart from this, the known cable connectors lack earthing.

It is an aim of the invention to avoid the disadvantages in cable connectors for electrical plug-in connections and by simple means to produce a cable connector suitable for long term application in wet surroundings, such as the water spray regions in underground mining.

Accordingly, the present invention is directed to a cable plug connector as described in the opening paragraph of the present specification, in which a multiple cornered part of metal provided with a through boring for the cable is screwed into the cable entry opening and the cable is fastened in a sealing manner, by means of a formed part formed on the cable covering, to the connector shell and to the multiple cornered part. By the conformation of a suitably formed part an extremely high protection against the ingress of moisture into the interior of the plug shell is produced. The advantages of the formed part comprise inter alia that it caters to a certain extent as a sealing body for the sealing of the cable to the plug shell and the cable entry opening. Since sealing imperfections owing to assembly deficiencies are excluded, quality control of the plug according to the invention can also be performed during the production of the plug-in connector, i.e. immediately following the conformation of the formed part from permanently elastic material. The multiple cornered part of metal, which touches the metal connector shell at the thread surfaces, effects at the same time a secure earthing of the cable.

Preferably the multiple cornered part is provided with threaded sections on its corner edges, so that the flat sides between the comer edges remain of flat construction. With the multiple cornered part screwed in several hollow spaces arise between the outer surface of the multiple edged part and the inner surface of the cable entry opening, into which cast masses of the formed part can penetrate. Preferably the through boring of the multiple cornered part has an indentation, whereby preferably the cable side boring section has a boring diameter which is larger than the diameter of the cable covering. In the intervening space thus created between the cable covering and the multiple cornered part the armouring or screening of the cable, which is turned back over the cable end when the conductor wires are exposed, can be laid in, so that here also the earthing of the cable to the cable connector is ensured.

Advantageously, a clamping sleeve is pushed into the cable side boring section. It is especially favourable then if the exposed armouring or screening of the cable is accepted between the cable side boring section of the multiple cornered part and the clamping sleeve. In a preferred embodiment during assembly the clamping sleeve is retained on the cable covering by a fixing band prior to the forming of the formed part.

Preferably also the length of the multiple cornered part is some 3 to 7 mm longer than the internal thread in the cable entry opening and/or the thread extends only over the cable side partial section of the cable entry opening, so that the multiple cornered part can be screwed self-locking into the cable entry opening. Since the multiple cornered part is longer than the thread, a narrow section of the multiple cornered part extends out of the connector shell, onto which a tool such as for instance a spanner can be applied for the final assembly. Advantageously, the multiple cornered part is a four cornered part.

Preferably, the formed part, is formed as a single part by a suitable plastics material, which material extends in the inside of the connector shell between the internal thread, the flat sides of the multiple cornered part and into the end of the boring and its larger end section outside the connector shell. By a suitable arrangement and conformation of the formed part all the cable side connection gaps between the inner space of the connector shell and its outside are sealed and also the hollow space between the connector shell and the multiple cornered part are filled, so that good sealing is achieved.

In a preferred embodiment a sealing ring encircling the cable covering is enclosed in a section of the formed part extending outside the connector shell. This sealing ring, which in a cost effective embodiment comprises an O-ring, forms an additional barrier against the ingress of moisture into the interior of the connector shell. The barrier arranged within the formed part effected by the sealing ring can especially come into effect if the formed part has partly loosened from the cable covering owing to strong vibration of the connected equipment or owing to tight radii of curvature of the cable.

The formed part can preferably comprise a permanently elastic cast or injection moulded body of a suitable plastics material.

Advantageously, the connector shell, the multi-cornered part and/or the clamping sleeve comprise brass.

An example of a cable connector made in accordance with the present invention will be described in greater detail herein below with reference to the accompanying drawing, in which.

Figure 1:
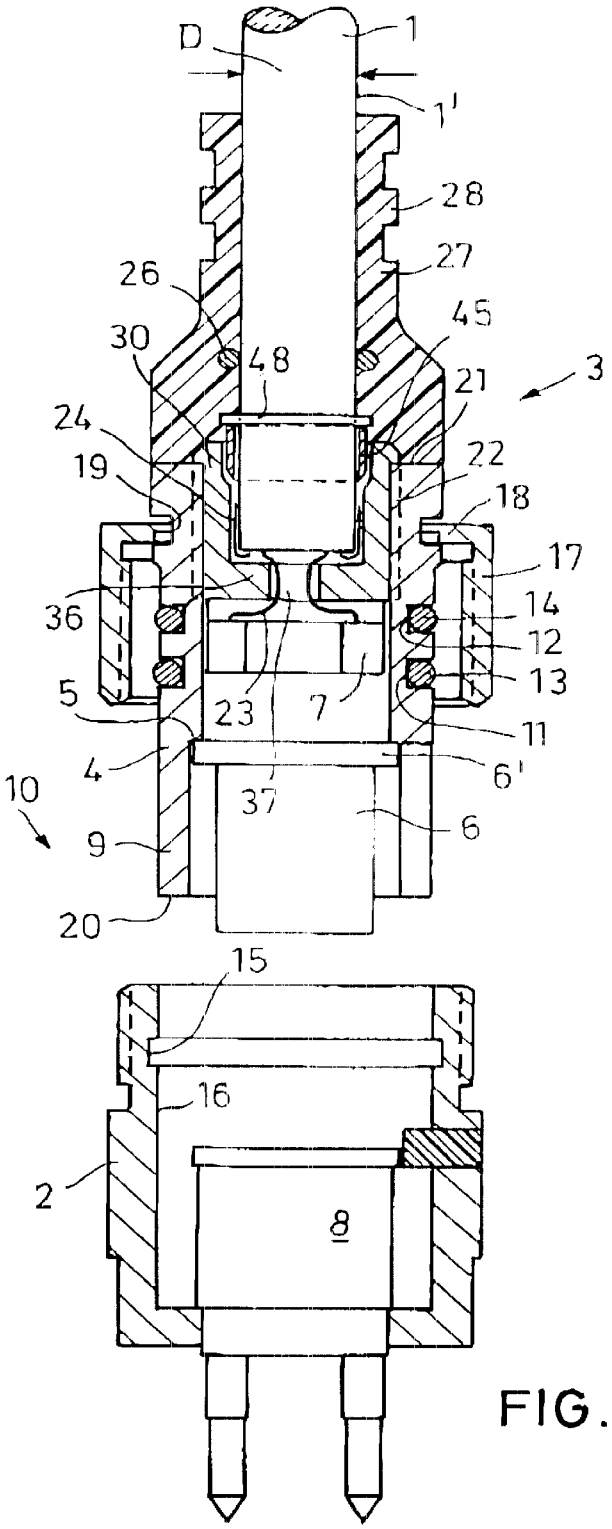
FIG. 1 shows a sectional view of a non-assembled electrical plug-in connector, for equipment in underground mining, which is formed from a cable plug and a socket part.

A plug-in connector 10 is shown in the drawing, which serves for the connection of a cable 1 for instance to an electro-hydraulic support controller, not shown in detail, such as are in multiple application in underground mining.

The plug-in connector 10 essentially comprises a socket part 2 and a cable plug 3. The cable plug 3, which forms the termination of the cable 1, has a hollow connector shell 4 of brass. The cable side section of the boring of the connector shell 4 forms a cable entry opening and has an abutment collar or engaging portion 5, onto which a plug connector 6 of plastics material with a collar 6' is supported axially in one direction. In the embodiment shown the plug connector 6 is supported on the socket side on the abutment collar or engaging portion 5. Alternatively the plug connector can also be supported on the cable side on an abutment collar or engaging portion, i.e. the plug connector is also then pushed into the plug shell through the cable entry opening. The plug connector 6 has, as is familiar, plug pins and/or sockets 7, whereby individual conductor wires 23 of the cable 1 are connected with the sockets 7 in the plug connector 6. In the assembled condition (not shown), the cable plug 3 of the plug-in connector 10, has plug pins 7 of plug connector 6 which plug pins 7 engage in matching sockets in the mating part 8 in the socket part 2 and alternatively, the sockets 7 of the plug connector 6 engage with corresponding plug pins in the mating part 8.

The connector shell 4 has a forward cylindrical guide trunnion 9, which here is provided with two axially sequential retaining grooves 11, 12 on its circumference both of which accept an elastic O-ring 13, 14. The arrangement is thereby so designed that the O-rings 13, 14 extend out radially from the retaining grooves 11, 12 somewhat over the circumferential surface of the guide trunnion 9. Alternatively only one O-ring and one retaining groove could be provided and the guide trunnion with the one retaining groove could then form the foremost section of the connector shell.

The socket part 2 is provided with an encircling locking groove 15 on its inner circumference 16, which, in the assembled condition lies in the same axial position as the forward retaining groove 11, in the push-in direction, so that in the assembled condition the forward O-ring 13 engages at the same time in the forward retaining groove 11 and in the locking groove 15 and secures the socket part 2 and the cable plug 3 against each other in the axial direction. Both the O-rings 13, 14 seal the plug connection 10 under radial tension in the assembled condition against the ingress of moisture and dirt.

A captive nut 17 mounted rotatably on the connector shell, which is provided with rearwards retaining flange 18, which engages in an encircling bearing groove 19, chiefly serves for reliable securing of the plug shell 4 and the cable plug 3 to the socket part 2. Alternatively the bearing groove for the captive nut and the retaining groove for the O-ring can also be arranged closer to the lower, here plug-in, end 20.

Figure 2:
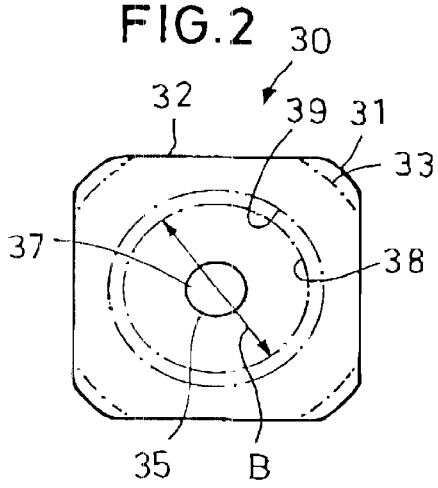
FIG. 2 shows an end view of a four cornered part of the cable connector according to the present invention.
Figure 3:
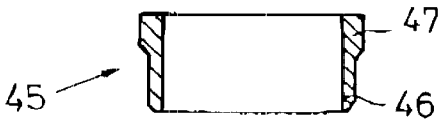
FIG. 3 shows a sectional view of a clamping sleeve for the cable connector according to the present invention.

FIG. 1 shows that the plug shell 4 is provided with an internal thread 22 at the cable introduction end 21, into which a blunt type four cornered part 30, shown enlarged in FIG. 2, is screwed. The four cornered part 30, preferably made from a rectangular brass rod has correspondingly four comer edges 31 and four flat sides 32, whereby the corner edges 31 are provided with threaded sections 33. The threaded sections 33 of all four corner edges 31 result together in a threaded track matched to the internal thread 22. The four cornered part 30 is provided with a through boring 35, which tapers at its lower end by means of the indentation 36 to a through hole 37, whose clear opening width is smaller than the cable diameter D (FIG. 1). A cable-receiving end boring section 38 of the four cornered part 30 has a diameter B, which is a few mm larger than the cable diameter. The boring section 35 comprises the through hole 37 and, adjacent thereto, a boring section 38 which is of larger diameter than the hole 37, and which leads to a boring end 39 of a further enlarged diameter, so that the clamping sleeve 45, shown in FIG. 3 can be pushed in between the cable covering 1' and the boring sections 38, 39 in the four cornered part 30. The clamping sleeve 45, of brass has a ring body 46 and a ring collar 47.

FIG. 1 shows the assembly condition of the plug shell 4, the four cornered part 30, clamping sleeve 45, cable 1 and plug connector 6. For assembly the conductor wires 23 and the armouring 24 of the cable 1 are first released and the conductor wires 23 are passed through the through hole 37 in the four cornered part 30. The armouring 24 is thereby clamped in between the cable covering 1' and the boring section 38, so that the cable 1 is earthed to the brass four cornered part 30. After the conductor wires 23 are joined to the plug-in sockets 7 in the plug connector 6, the four cornered part 30 is screwed into the internal thread 22; hereby full earthing is effected owing to the metallic connection between the armouring 24, the four cornered part 30 and the connector shell 4. The length of the internal screw thread 22 extends only over a partial section of the cable entry opening, so that the four cornered part 30 can be screwed self-locking into this. The length of the four cornered part 30 itself is longer than the length of the internal thread 22.

The clamping sleeve 45 with the ring collar 47 is pushed into the component pre-assembled in this manner from the rear side, i.e. from the cable entry end 21, into the boring section 38 and retained by a fixing band 48. The clamping sleeve 45 supports the axial fixing of the cable 1 in the connector shell 4 with its deeply pushed in ring collar 47. After an O-ring 26 is attached at the prescribed distance from the cable entry end 21, a formed part 27 can be formed by casting or injection moulding from suitable plastics material, for instance using two half shells, surrounding the end of the connector shell 4. A part of the plastics material hereby also penetrates into the intervening space between the flat sides 32 of the four cornered part 30 and the internal thread 22 as well as further between the cable end boring section 39 and the indentation 36 of the four cornered part 30 and through the through hole 37 into the plug connector 6. This is achieved by only one injection process and leads inter alia to adhesion of the injected material to the plug connector 6, which is fixed at the same time. The formed part 27 forms the termination of the cable plug 3, whereby the sealing ring 26 is enclosed in a larger end section 28 of the formed part 27, extending outside the plug shell.

What is claimed is:

1. A cable plug connector for electrical cable connections, especially for plug-in couplings of electrical cable connections in underground mining, with a connector shell of metal, which has a cable entry end and a cable entry opening therein, said opening provided with an internal thread and an abutment collar or engaging portion for a plug connector of plastics material, which is equipped with plug pins and/or sockets, which are joined to the cable conductors of a single or multi-connector cable, which is provided with screening or armouring, a multiple cornered part of metal being provided with threaded sections on its corner edges and also provided with a through boring for the cable, wherein the multiple cornered part is screwed into the cable entry opening of the connector shell such that the threaded sections of the corner edges engage the internal thread of the connector shell and the cable is fastened in a sealed manner, by means of a formed part formed on the cable covering, to the multiple cornered part and to the connector shell.

2. A cable plug connector according to claim 1, in which the through boring of the multiple cornered part has an indentation, whereby an end of the boring at the cable entry end has a bore diameter which is larger than the diameter of the cable covering.

3. A cable plug connector according to claim 2, in which the clamping sleeve is retained on the cable covering by a fixing band prior to the forming of the formed part.

4. A cable plug connector according to claim 1, in which a clamping sleeve is pushed into an end of the boring at the cable entry end.

5. A cable plug connector according to claim 1, in which the exposed armouring or screening of the cable is accepted between of the multiple cornered part and the cable covering.

6. A cable plug connector according claim 1, in which the length of the multiple cornered part is some 3 to 7 mm longer than the internal thread in the cable entry opening and/or the thread extends only over a partial section of the cable entry opening which is on the cable entry end.

7. A cable plug connector according to claim 1, in which the multiple cornered part is a four cornered part.

8. A cable plug connector according to claim 1, the multiple cornered part having flat sides formed in between the corner edges and the formed part, is formed as a single part by a suitable plastics material, which material extends in the inside of the connector shell between the internal thread and flat sides provided by the multiple cornered part, and in between the throughole at the end of the boring opposite to the cable entry end and its larger end section adjacent to the cable entry end outside the connector shell.

9. A cable plug connector according to claim 8, in which the sealing ring is an O-ring.

10. A cable plug connector according to claim 1, in which a sealing ring encircling the cable covering is enclosed in a section of the formed part extending outside the connector shell.

11. A cable plug connector according to claim 1, in which the formed part comprises a permanently elastic cast or injection moulded body of plastics material.

12. A cable plug connector according to claim 1, in which the connector shell, the multi-cornered part and/or a clamping sleeve which is pushed into a side of the boring section at the cable entry end comprise brass.

* * * * *